United States Patent [19]

Plyler et al.

[11] Patent Number: 4,620,381

[45] Date of Patent: Nov. 4, 1986

[54] DITCHING MACHINE WITH OFFSET DRAFT VEHICLE

[75] Inventors: Gary M. Plyler, Georgetown; Michael G. Tisdale, Andrews, both of S.C.

[73] Assignee: Westvaco Corporation, New York, N.Y.

[21] Appl. No.: 747,578

[22] Filed: Jun. 24, 1985

[51] Int. Cl.[4] ..... E02F 5/02

[52] U.S. Cl. ..... 37/98; 172/677

[58] Field of Search ..... 37/98; 172/134, 200, 172/677

[56] References Cited

U.S. PATENT DOCUMENTS

| | | | |
|---|---|---|---|
| 101,729 | 4/1870 | Harmon | 37/98 |
| 1,212,421 | 1/1917 | Tetzloff | 37/98 |
| 2,320,855 | 6/1943 | Dukes | 37/98 |
| 2,784,506 | 3/1957 | Heft | 37/98 |

FOREIGN PATENT DOCUMENTS

| | | | |
|---|---|---|---|
| 259435 | 10/1926 | United Kingdom | 37/98 |

*Primary Examiner*—Clifford D. Crowder

*Attorney, Agent, or Firm*—W. A. Marcontell; R. L. Schmalz

[57] ABSTRACT

This two-wheeled machine for cutting and dressing road shoulders and drainage ditches is designed to be towed behind a powered tractor. A ditch cutting disc is directly connected to an offset portion of the machine frame. The ditch end of a scraper blade is structurally attached behind the cutting disc from the disc mounting structure. An offset draft bar permits the tow tractor to be operated closer to the road center and out of the road gutter as the outboard wheel of the ditching machine runs in the ditch channel.

5 Claims, 6 Drawing Figures

DITCHING MACHINE WITH OFFSET DRAFT VEHICLE

BACKGROUND OF THE INVENTION

1. Field of the Invention

The present invention relates to earth moving and excavating equipment. More particularly, the invention relates to road maintenance equipment adapted to clear and cut road shoulders and drainage ditches.

2. Description of the Prior Art

Sparsely traveled rural and logging roads are constructed with a minimum of roadbed packing and preparation. To protect the center crown of such roads from washouts by heavy rains and flood water, it is necessary to ditch such roads along both sides with shallow drainage trenches. These trenches ease the drainage course from under the road-bed crown and tend to prevent water saturation of the road-bed in the load bearing area.

In flat, low-lying areas, having considerable rainfall, road drainage ditches hold standing water throughout much of the year. High water tables and the absence of elevational fall are the dominate obstacles to sufficient road drainage in such areas. However, siltage washed from the road and surroundings aggravate natural drainage obstacles by filling and blocking the road ditches. To keep such roads serviceable, it is necessary to periodically recut the ditches and scrape the excavated material back upon the road crown.

Road building and maintenance arts have traditionally relied upon grading machinery to cut and maintain road drainage ditches. Such machinery is constructed and used as either self-powered or towed vehicles; usually having four to six wheel support points for a horizontal quadrant mounted scraper blade. From the central quadrant, a scraper blade usually is constructed to extend unsupported eight to ten feet in each lateral direction. When used for cutting road drainage ditches, it is at the outer ends of the blade that the greatest load is imposed on the equipment i.e. the greatest load is imposed at the weakest structural point.

Motor graders of traditional design are being driven by traction wheels running in the ditch being cut. If the ditch soil is water saturated, poor traction and sinking results.

Towed graders of traditional design have the same problem translated to the tractor vehicle. Additionally, two operators are required for the unit operation: one for the tractor and one for the grader. Considerable teamwork skill between the two operators is necessary for safe and adequate performance.

It is therefore, an object of the present invention to teach the construction and design of a towed vehicle specifically suited for road ditching and shoulder grading.

Another object of the present invention is to teach the construction of a towed ditch maintainer that requires no separate operator for the maintainer.

Another object of the present invention is to teach the design and construction of a road ditching machine having maximal structural strength concentrated at the greatest loading point.

Another object of the present invention is to teach the design and construction of a towed ditching machine that permits the powered tractor vehicle to run in an offset track closer to the road crown center and out of the ditch trench.

SUMMARY

These and other objects of the invention which will appear from the forthcoming description are accomplished by an asymmetric vehicle frame carried on two, wheel suspension points rotating about a single axis. The wheels support a scraper blade in the draft position behind the wheel axis from the hitch point. Only vertical weight support is provided for the scraper blade at its mid-point. At the inboard or lightly loaded end of the scraper blade, scraping load is transferred to the frame by a tensile draft bar. The outboard end of the scraper blade is attached to a gusset braced vertical strut depending from the primary frame unit. Also attached to the gusseted strut is a cutting disc which is disposed in front of the scraper blade outboard tip.

The draft bar for this towed vehicle is pivotal about a vertical axis to swing an arc from the longitudinal vehicle axis position toward the vehicle inboard side.

BRIEF DESCRIPTION OF THE DRAWINGS

Relative to the drawings wherein like reference characters designate like or similar elements throughout the several figures of the drawings.

DESCRIPTION OF THE PREFERRED EMBODIMENT

Figure 1:
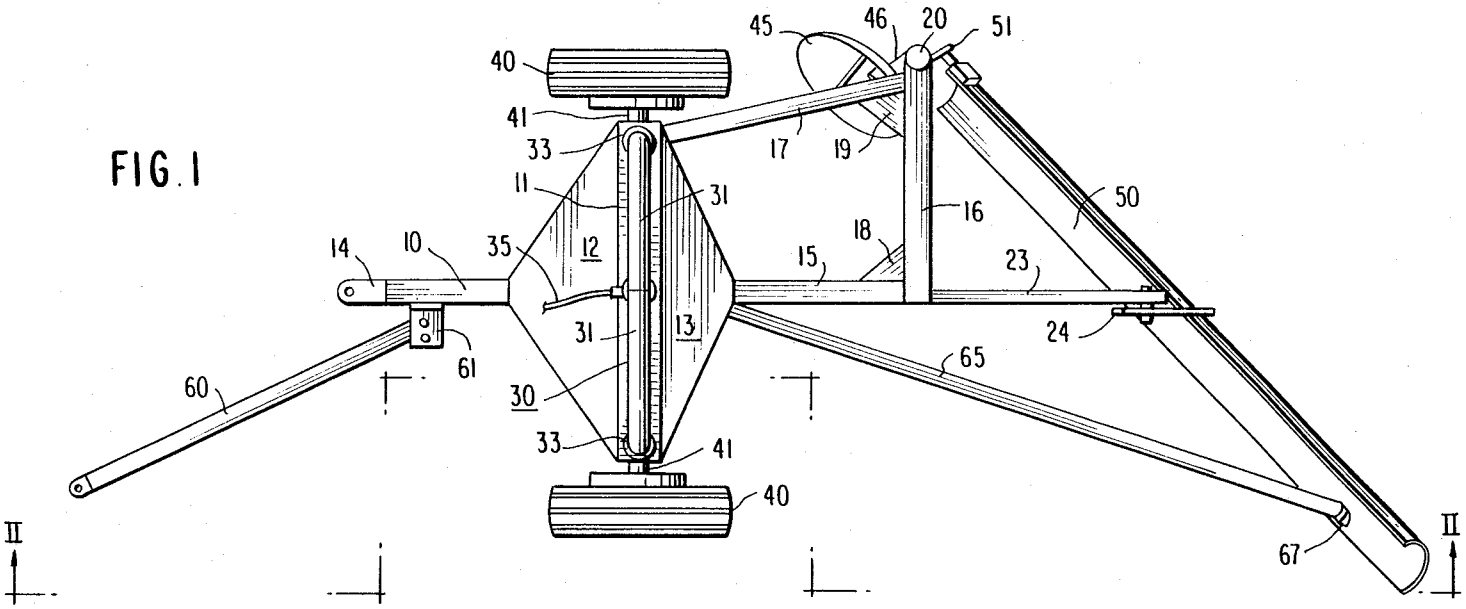
FIG. 1 is a plan view of the present invention.
Figure 2:
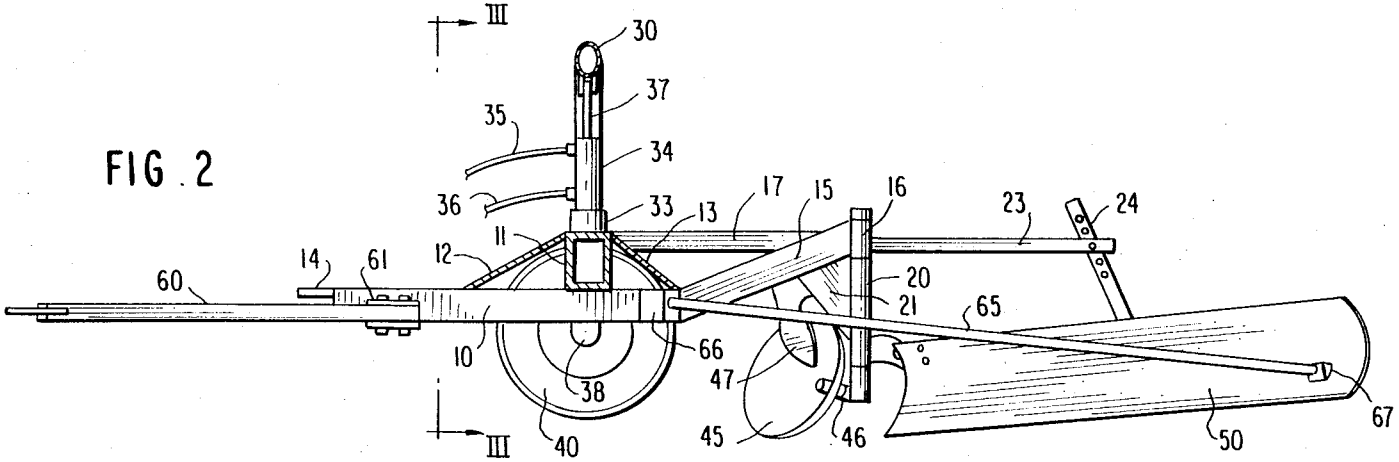
FIG. 2 is a partially sectioned side elevation view of the present invention viewed along cutting planes II—II of FIG. 1.
Figure 3:
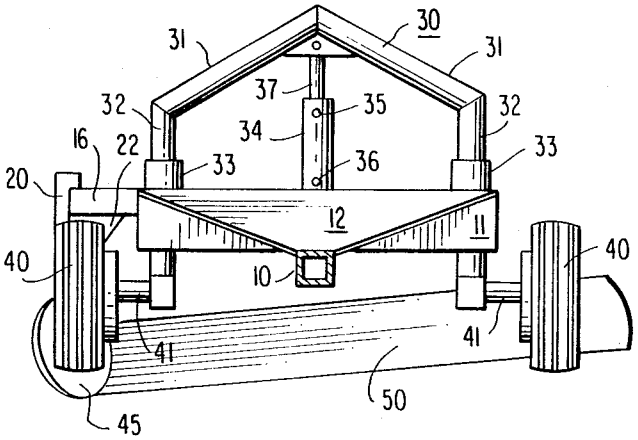
FIG. 3 is a partially sectioned end elevation view of the invention viewed along cutting plane III—III of FIG. 2.

Construction of the present invention is taught from a coordinated reference to FIGS. 1, 2 and 3 which shows a primary superstructure comprising a single frame keel member 10 having an overlying cross-beam 11 secured thereto. The torsional rigidity between keel 10 and cross-beam 11 is reinforced by fore and aft gusset plates 12 and 13.

The fore end of the keel is provided with a conventional draft hitch 14 whereas the keel aft end 15 is turned upwardly to terminate with a rib-beam 16. Longeron 17 closes an irregular trapezoid between the cross-beam 11 and the rib-beam 16. Corner gussets 18 and 19 contribute rigidity to the trapezoid.

The outboard end of the rib-beam 16 supports a vertical tool strut 20 which is longitudinally braced by gusset 21 and laterally braced by gusset 22.

A relatively light tail boom 23 projects from the keel aft 15 to support a hanger bar 24.

Wheel carriage for the superstructure comprises an arched axle 30 having rafter braces 31 and leg struts 32. Collar braces 33 secured to and within the cross-beam 10 slidably receive the leg struts 32 and provide lateral rigidity between the wheel carriage and superstructure.

Vertical support for the superstructure from the wheel carriage is provided by a single hydraulic cylinder 34 secured between the apex of the arched axle 30 and the cross-beam 11. Hydraulic lines 35 and 36 charge the cylinder 34 on opposite faces of an internal piston with oil from a pressure source not shown for the purpose of adjusting and setting the stroke position of a piston connected rod 37. Projection of the rod 37 determines the relative height of the superstructure above the axis 38 of support wheels 40. Ultimately, cylinder 34 and rod 37 determine the cutting depth of the invention digging tool.

At the lower ends of the leg struts 32, stub axles 41 are provided for mounting wheels 40.

Figure 4:
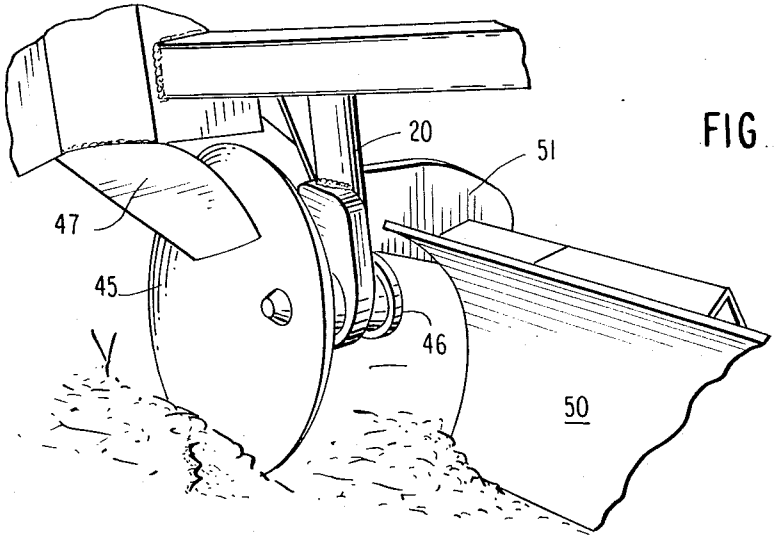
FIGS. 4 and 5 are detailed pictorials of the invention digging tools and respective mountings.
Figure 5:
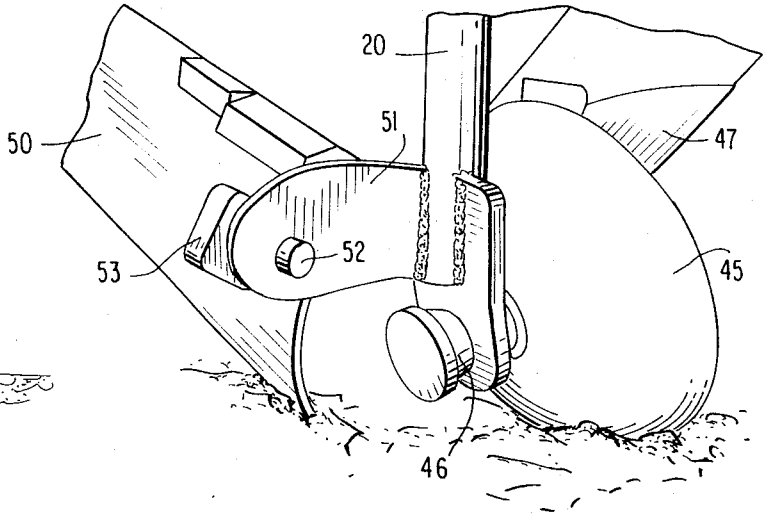

The digging tools of this invention comprise a roller disc 45 and scraper blade 50, both of which are pivotally supported by appropriate brackets to the lower end of tool strut 20 as best seen from FIGS. 4 and 5. Roller disc 45 is a concave or bowl shaped disc of tool steel having a rotational bearing mount 46 about the disc axis of revolution. This axis is set obliquely to the vehicle draft direction and to the horizontal plane so that the lower cutting edge of the disc has a shallow downward cutting angle into the earth when in operation. The disc axis angle to the vehicle draft direction drives rotation of the disc when cutting. A fixed cleaning blade 47 scrapes the internal surface of the disc 45 for discharge of cut material toward the inboard side of draft direction for inward displacement by the following scraper blade 50.

The scraper blade is connected to and supported from strut 20 by means of hanger plate 51 and axle bar 52. A journal box 53 secured to the scraper backside pivotally receives the axle bar for positional security of the scraper blade outboard end. This arrangement holds the most heavily loaded, ditching end of the blade securely to the tool strut in all directions except for rotation about the axle bar 52. Rotation about the axle bar permits adjustment of the blade scrapping angle.

The more lightly loaded, inboard end of the scraper blade is longitudinally restrained by strut bar 65 secured between bracket 66 on the frame keel and bracket 67 on the face of the blade. To adjust the sweep angle of blade 50, strut bar 65 must be adjustable in length. Any of several devices to accomplish such adjustments may be used. For example, the strut bar 65 may be the threaded, coaxial assembly of two bars. Other length adjustment alternatives may include interchangeable bars of different length. A turn-buckle joint in the bar length or most simply, since the predominate load on the bar is tensile, a linked chain may be used in lieu of a compressively stiff bar element.

Hanger bar 24, pivotally bolted to tail boom 23, supports most of the vertical weight of the scraper blade but little of the cutting load.

Figure 6:
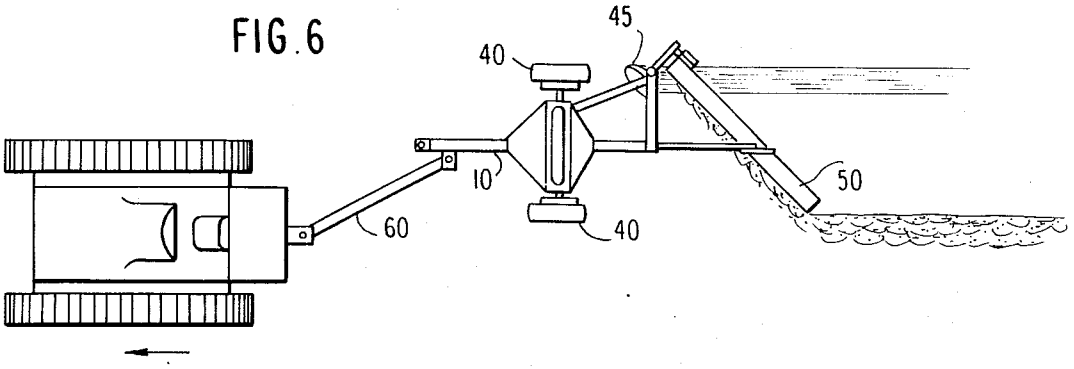
FIG. 6 is a schematic plan of the invention in operational tow by a tractor.

At the front end of frame keel 10 is a laterally swinging draft bar 60 which is pivoted about a vertical axis through hanger brackets 61. FIG. 6 illustrates the draft bar 60 connected to a tow tractor for offset pulling of the ditching machine. The degree of offset is determined largely by the cutting depth of the disc 45 which provides a clockwise turning moment about a vertical axis through the mid-point between wheels 40. This clockwise moment is countered by the counterclockwise moment of the draft bar 60 for resultant straight tracking of the wheels 40 along a laterally offset line behind the tow tractor thereby permitting the tractor to run out of the ditch.

Having fully described our invention, We claim:

1. A ditching machine comprising primary frame structure supported by wheel suspension structure, said wheel suspension structure comprising a wheel support unit respective to laterally opposite sides of said frame structure, said wheel support units being rotational about a single common wheel axis extending transversely of said primary frame structure, vertical adjustment means secured between said frame structure and said wheel suspension structure for selectively adjusting a vertical position of said frame structure relative to said wheel axis, said primary frame structure including a primary draft bar extending forwardly of said wheel axis and tool mounting means behind said wheel axis, said tool mounting means comprising first bearing support means for securing a convex cutting disc rotationally about a disc axis and second bearing support for positionally securing one end of a scraper blade in draft position behind said cutting disc, said cutting disc and said one end of said scraper blade being positioned laterally of a longitudinal center axis of said machine passing substantially equidistantly between said wheel support units, and an auxiliary draft bar pivotally secured to said primary draft bar forward of said wheel axis for hitching to a draft vehicle at a draft point laterally offset from said machine longitudinal center axis opposite from said cutting disc whereby operationally dynamic turning moments about a central vertical axis between said wheel support units are balanced.

2. A ditching machine as described by claim 1 wherein the rotational axis of said cutting disc is set at an oblique angle to said wheel axis and to said longitudinal vehicle axis.

3. A ditching machine as described by claim 1 wherein said tool mounting means is a vertical strut secured behind one of said wheel support units to position said cutting disc in the track of said one wheel support unit.

4. A ditching machine as described by claim 1 wherein said wheel suspension structure comprises a pair of vertically disposed wheel mounting legs, said legs being laterally restrained by and axially slidable through respective collar means secured to said frame structure.

5. A ditching machine as described by claim 4 wherein said vertical adjustment means comprises piston and cylinder means charged by pressurized fluid, said piston and cylinder means disposed between said frame structure and said wheel mounting legs to adjust the vertical position of said frame structure.

* * * * *